US006984939B2

(12) United States Patent
Gilles

(10) Patent No.: US 6,984,939 B2
(45) Date of Patent: Jan. 10, 2006

(54) ELECTRODE FOR A HIGH-PRESSURE DISCHARGE LAMP

(75) Inventor: Jörg Alexander Gilles, Berlin (DE)

(73) Assignee: Patent-Treuhand-Gesellschaft für elektrische Glülampen mbH, Munich (DE)

( * ) Notice: Subject to any disclaimer, the term of this patent is extended or adjusted under 35 U.S.C. 154(b) by 176 days.

(21) Appl. No.: 10/751,939

(22) Filed: Jan. 7, 2004

(65) Prior Publication Data

US 2004/0140767 A1 Jul. 22, 2004

(30) Foreign Application Priority Data

Jan. 16, 2003 (DE) ..... 103 01 478

(51) Int. Cl.
*H01J 61/073* (2006.01)

(52) U.S. Cl. ..... 313/631; 574/491; 574/356

(58) Field of Classification Search ..... 313/491, 313/326, 345, 356, 574, 631, 632, 346 R, 313/354

See application file for complete search history.

(56) References Cited

U.S. PATENT DOCUMENTS

| | | | | |
|---|---|---|---|---|
| 2,887,603 | A * | 5/1959 | Haidinger | 313/570 |
| 3,560,790 | A * | 2/1971 | Vollmer et al. | 313/355 |
| 3,916,241 | A | 10/1975 | Pollard | |
| 3,983,440 | A * | 9/1976 | Scott et al. | 313/566 |
| 5,061,877 | A * | 10/1991 | Akanuma | 313/631 |
| 6,518,692 | B2 * | 2/2003 | Schoenbach et al. | 313/356 |

* cited by examiner

*Primary Examiner*—Ashok Patel
(74) *Attorney, Agent, or Firm*—William E. Meyer

(57) ABSTRACT

The electrode comprises a pin-like shank (7) and a head part (8), the electrode, in the region of its discharge-side end, forming a vessel (9) for an emitter, in which there is a bore (16) which is filled with emitter material (10). The vessel, at its discharge-side end face, forms a collar, having an inner collar part (13) which is curved convexly toward the bore and an outer collar part (14) which is curved convexly toward the side wall of the vessel.

9 Claims, 4 Drawing Sheets

ELECTRODE FOR A HIGH-PRESSURE DISCHARGE LAMP

TECHNICAL FIELD

The invention is based on an electrode for a high-pressure discharge lamp, said electrode being made from high-melting, electrically conductive material, comprising a pin-like shank having a head part, the electrode forming, in the region of its discharge-side end, a vessel for an emitter, in which there is a bore which is filled with emitter material. It deals in particular with electrodes for high-pressure discharge lamps which contain sodium, and in particular with sodium high-pressure lamps. Pure Hg high-pressure discharge lamps represent an example of a further application area.

BACKGROUND ART

U.S. Pat. No. 3,916,241 has already disclosed an electrode for a high-pressure discharge lamp in which an emitter is inserted into a cavity at the head of the electrode. In this arrangement, the pellet which contains the emitter is protected from direct arc attachment by being inserted to a suitable depth.

DISCLOSURE OF THE INVENTION

It is an object of the present invention to provide an electrode made from high-melting, electrically conductive material, comprising a pin-like shank having a head part, the electrode forming, in the region of its discharge-side end, a vessel for an emitter, in which there is a bore which is filled with emitter material, said electrode counteracts premature aging of the lamp.

This object is achieved by the following features: the vessel, at its discharge-side end face, forms a collar, having an inner collar part which is curved convexly toward the bore and an outer collar part which is curved convexly toward the side wall of the vessel. Particularly advantageous configurations are given in the dependent claims.

In operation, the emitters used in discharge lamps have a high mobility in the discharge vessel, caused in particular by sputtering. Therefore, over the course of time the emitter substances precipitate on all the walls of the discharge vessel. Moreover, they have a lasting effect on the chemical and physical processors while the lamp is operating, and may in particular modify the fill. Overall, therefore, the useful service life of the lamp is shortened.

The emitter and also its reservoir is located at a reliably defined site at which it is not exposed to a sputtering process by means of the hollow electrode described here.

The emitter material which reduces the electron work function, which is often an oxide or an oxidic material, such as Ba tungstate, Ca tungstate, Y tungstate, is in this case introduced into open, central or excentric bores which are located at the arc-side end of the electrode, either in the core pin, which in particular projects, or in the head of the electrode itself. If the diameter of the hole and its volume are selected appropriately and if the edge of the hole is suitably configured, it is possible to dispense with the need for an additional covering or alternatively with the need for the hole to be particularly deep. In particular, it is also possible to substantially dispense with the need for the emitter level, i.e. the surface of the emitter, to be countersunk in the hole.

The emitter-filled body can be provided in a conventional way with an outer winding made from high-melting metal.

The winding may comprise one or more layers. This winding can serve as the arc attachment and imparts a higher heat capacity.

The base material used to produce the electrode is a high-melting metal, usually tungsten, tantalum, rhenium or an alloy or carbide of these metals. The electrode is held in the discharge vessel by a supply conductor and is led out of a discharge vessel.

The electrode according to the invention can be used both in all cylindrically symmetrical ceramic discharge vessels and those made from glass for high-pressure discharge lamps. The emitter material which reduces the work function is in this case introduced into an open bore located at the arc-side end of the electrode.

The emitter material may be a pellet, i.e. a solid body, but it is also possible to use a liquid or paste, which allows simple application of the emitter material by means of an immersion bath treatment. In this case, a second step is the shaping, if required. This depends on whether or not the emitter is oxidic.

The electrode is simple to produce if the edge of the hole is suitably shaped. In this case, the hole is surrounded by a collar which has a defined internal and external radius. These radii are selected in such a way that the discharge arc preferably attaches itself to the outer part of the collar. The inner part, which forms the edge of the hole, has to be produced with a sufficient freedom from burrs.

Moreover, it is preferable for the surface of the emitter material in the hole to be concave. Furthermore, the diameter, depth and centricity of the emitter-filled internal volume, preferably designed as a hole, are preferably selected in such a manner that damage to the core pin outer wall is prevented and that the maximum quantity of emitter which can be introduced is of a similar order of magnitude to that which can be achieved with a conventional paste.

As an alternative to an outer winding, it is possible to select a corresponding solid head of the electrode, which is designed to be solid or in the form of a sintered body.

BRIEF DESCRIPTION OF THE DRAWINGS

The text which follows is intended to explain the invention in more detail with reference to a plurality of exemplary embodiments. In the drawing.

BEST MODE FOR CARRYING OUT THE INVENTION

Figure 1:
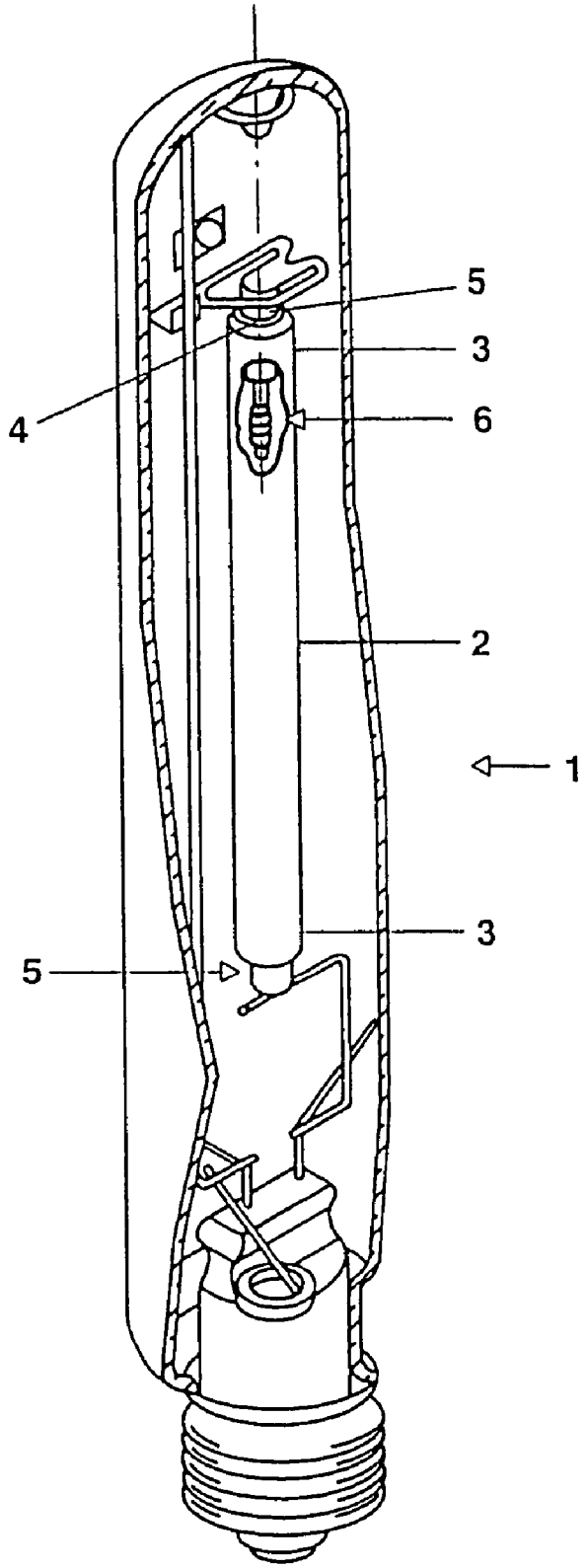
FIG. 1 shows a high-pressure discharge lamp, in section.

FIG. 1 shows a sodium high-pressure lamp 1 with a power of 70 W, having a ceramic discharge vessel 2 which is closed on two sides. Two outer supply conductors 5, which are connected to electrodes 6 in the interior of the discharge vessel, are sealed into the ends 3 by means of soldering glass 4.

Figure 2:
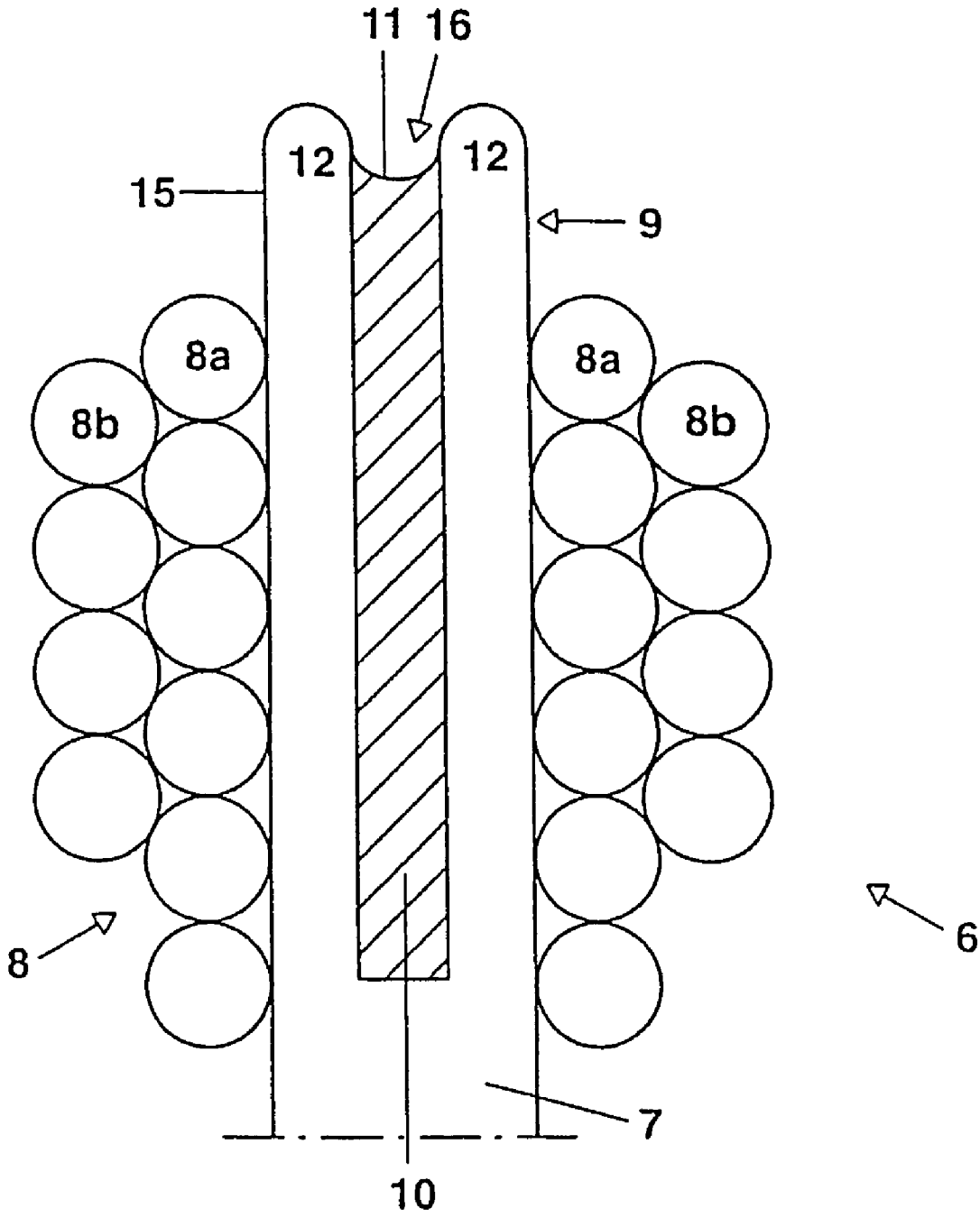
FIG. 2 shows an electrode for the lamp shown in FIG. 1, in section.

FIG. 2 shows an enlarged illustration of the electrodes 6. The electrodes 6 comprise core pins 7, onto which a filament body 8 has been pushed. This body forms the head part, as it were. Both components consist of tungsten. The diameter of the core pin is 700 μm, while that of the filament body 8 is at most 1700 μm, with a wire diameter of 200 μm.

The filament body 8 comprises two layers 8*a* and 8*b* of windings. On the discharge side, the end of the core pin 7 projects with respect to the filament body 8. Here, it forms the emitter vessel 9 with a central bore 16 which is virtually completely filled with emitter material 10. This material has a concave surface 11 on the discharge side close to the end of the bore 16.

Figure 3:
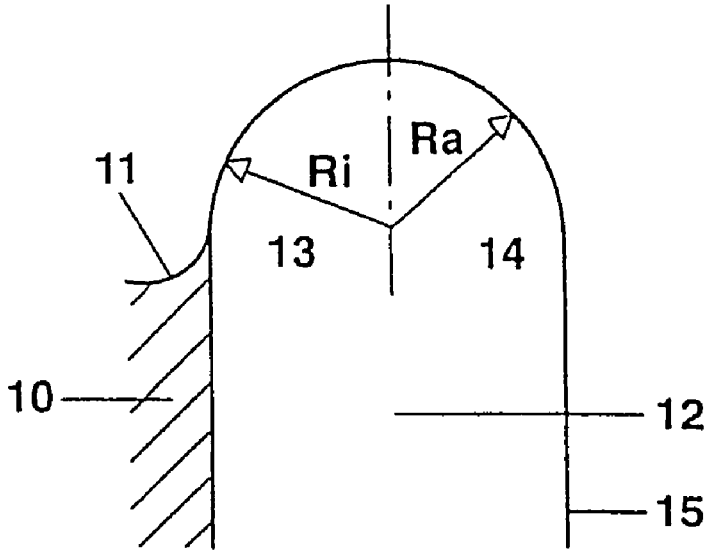
FIG. 3 shows an enlarged excerpt from the electrode shown in FIG. 2.

FIG. 3 shows on an enlarged scale how the vessel wall 12 forms a collar which can be divided into an inner collar part 13, which is curved convexly toward the bore and has the radius of curvature Ri, and an outer collar part 14, which is curved convexly toward the outer side wall 15 of the vessel and has a radius of curvature Ra which is equal to Ri.

A specific example of an emitter material in addition to the tungstates is thorium oxide.

The specific dimensions of the emitter vessel are as follows:

| | |
|---|---|
| External diameter | 700 μm |
| Internal diameter | 300 μm |
| Depth of the hole | 4.5 mm |
| Inner radius of curvature Ri | 140 μm |
| Outer radius of curvature Ra | 140 μm |

The difference in the light yield compared to a lamp with a conventional electrode is 2.2% even after just 100 hours and rises continuously as the operating time increases. The formation of deposits on the inner sides of the ends of the discharge vessel is significantly lower than with a conventional embodiment even under visual inspection.

Figure 4:
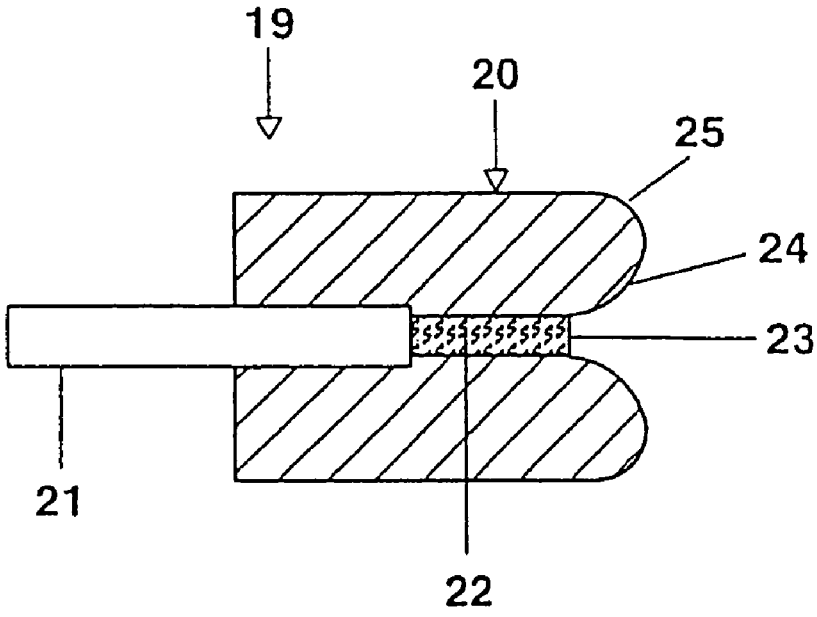
FIG. 4 shows a further exemplary embodiment of an electrode for the lamp shown in FIG. 1, in section.
Figure 5A:
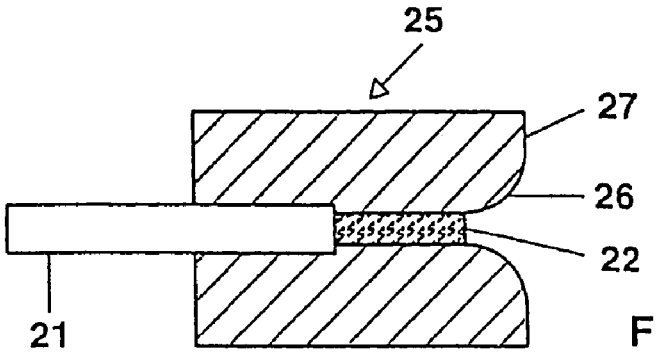
FIG. 5 shows further exemplary embodiments of electrode vessels.
Figure 5B:
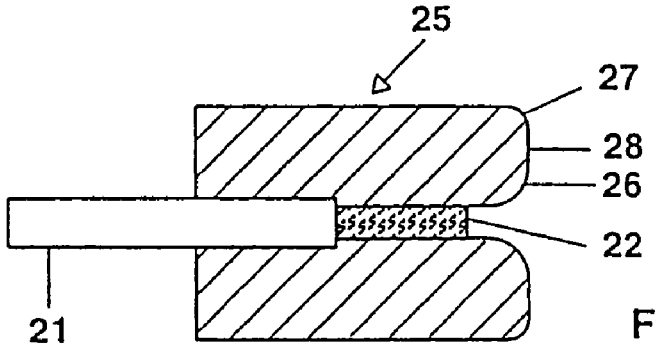
Figure 5C:
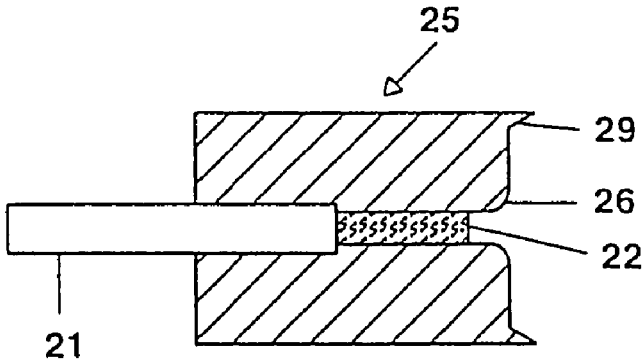
Figure 5D:
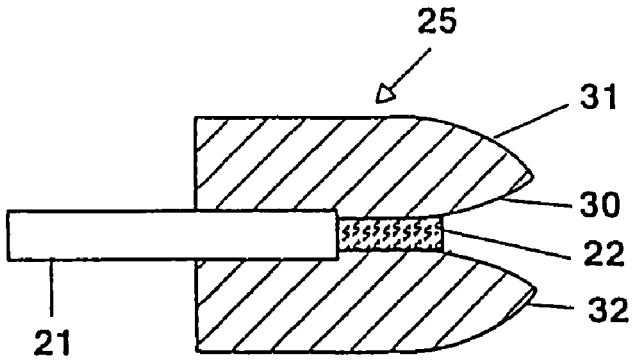

FIG. 4 shows another exemplary embodiment of an electrode 19, in which the emitter vessel is formed by the head 20 of the electrode, which is designed as a sintered body made from tungsten. It is positioned on a separate shank 21 made from solid tungsten. The emitter material is a pellet 22 in the central hole 23. The radii of curvature of the inner and outer collar parts 24 and 25 differ. By way of example, the inner radius of curvature is 140 μm and the outer radius of curvature is 60 μm. The overall dimensions of solid electrodes of this type are of the order of magnitude of similar electrodes based on a core pin with an outer winding.

Further embodiments of the electrodes are shown in FIG. 5. In this case, the emitter vessel 25 is designed as a head. However, it may also be formed by a core pin. FIG. 5*a* shows an exemplary embodiment in which the inner collar part 26 has a defined radius of curvature and is connected to the outer collar part 27 via a straight piece, as a tangent thereon (infinite radius of curvature). The outer collar part is an edge with a radius of curvature of zero. FIG. 5*b* shows an exemplary embodiment in which the inner and outer collar parts 26 and 27 have a defined radius of curvature, and between the inner and outer collar parts there is a connecting tangent 28 thereon. FIG. 5*c* shows an exemplary embodiment similar to FIG. 5*a*, in which a high field strength is generated at the outer collar part by a point 29. Finally, FIG. 5*d* shows an exemplary embodiment with a pin-like collar, in which the inner and outer radii of curvature of the inner and outer collar parts 30 and 31 differ and the collar parts are not smooth, but rather adjoin one another at a point 32.

As an alternative to a specific curvature with a given radius of curvature, it is at least necessary for the outer collar part to be configured in such a way that the arc as far as possible finds a higher electrical field strength at the outer collar part than in the inner collar part. This can also be achieved by using a suitable point in the region of the outer collar. By contrast, the curvature in the region of the inner collar part should as far as possible generate low electrical field strengths. Therefore, the surface of the inner collar part must be as smooth as possible and may not have any burrs or points.

A suitable production process is spark or electrode erosion. A further technique is laser ablation. In general terms, the electrical field strength which is generated by the surface of the outer collar part should be greater than the electrical field strength generated by the surface of the inner collar part. Therefore, it is not the absolute value of the radii of curvature, but rather the relationship between the radii of curvature which is the crucial factor.

In this context, the width of the inner collar part may advantageously form at least 20%, and typically 40 to 60%, of the wall thickness of the emitter vessel.

What is claimed is:

1. An electrode made from high-melting, electrically conductive material, comprising a pin-like shank having a head part, the electrode forming, in the region of its discharge-side end, a vessel for an emitter, in which there is a bore which is filled with emitter material, wherein the vessel, at its discharge-side end face, forms a collar, having an inner collar part which is curved convexly toward the bore and an outer collar part which is curved convexly toward the side wall of the vessel.

2. The electrode as claimed in claim 1, wherein at least one of the convex curvatures has a defined radius of curvature.

3. The electrode as claimed in claim 2, wherein both curvatures have a defined radius of curvature.

4. The electrode as claimed in claim 3, wherein the inner radius of curvature, Ri, of the inner collar part is greater than or equal to the outer radius of curvature, Ra, of the outer collar, i.e. $Ri \geqq Ra$.

5. The electrode as claimed in claim 1, wherein the discharge-side surface of the emitter material is curved concavely.

6. The electrode as claimed in claim 1, wherein the vessel is formed by the discharge-side end of the shank, which is designed as a core pin.

7. The electrode as claimed in claim 1, wherein the vessel is formed by a separate head part of the electrode.

8. The electrode as claimed in claim 1, wherein the emitter vessel is made from tungsten.

9. A lamp having an electrode as claimed in claim 1.

* * * * *